US006978942B2

(12) United States Patent
Murdoch

(10) Patent No.: US 6,978,942 B2
(45) Date of Patent: Dec. 27, 2005

(54) SHOCKWAVE INJECTOR NOZZLE

(75) Inventor: Peter John Murdoch, Elsternwick (AU)

(73) Assignee: Orbital Engine Company (Australia) Pty Limited, Balcatta (AU)

( * ) Notice: Subject to any disclaimer, the term of this patent is extended or adjusted under 35 U.S.C. 154(b) by 234 days.

(21) Appl. No.: 10/311,310

(22) PCT Filed: Jun. 29, 2001

(86) PCT No.: PCT/AU01/00780

§ 371 (c)(1),
(2), (4) Date: Jul. 11, 2003

(87) PCT Pub. No.: WO02/02932

PCT Pub. Date: Jan. 10, 2002

(65) Prior Publication Data

US 2004/0021015 A1 Feb. 5, 2004

(30) Foreign Application Priority Data

Jun. 30, 2000 (AU) ..... PQ 8523

(51) Int. Cl.[7] ..... A62C 5/02; B05B 1/26

(52) U.S. Cl. ..... 239/8; 239/424; 239/433; 239/453; 239/500; 239/506; 239/515; 239/533.7; 239/584; 123/294

(58) Field of Search ..... 239/8, 533.7, 533.12, 239/453, 584, 585.1, 424, 433, 101, 500, 239/505, 506, 513, 514, 515; 123/294, 301, 123/305

(56) References Cited

U.S. PATENT DOCUMENTS

| | | | | |
|---|---|---|---|---|
| 3,923,248 | A | 12/1975 | Cresswell | |
| 4,361,285 | A * | 11/1982 | Koppehele et al. | 239/424 |
| 4,378,088 | A * | 3/1983 | Ewing | 239/8 |
| 4,688,755 | A | 8/1987 | Pluviose | |
| 4,702,415 | A * | 10/1987 | Hughes | 239/8 |
| 4,972,830 | A * | 11/1990 | Wong et al. | 239/358 |
| 5,513,798 | A * | 5/1996 | Tavor | 239/8 |
| 5,551,638 | A | 9/1996 | Caley | |
| 6,003,789 | A | 12/1999 | Base et al. | |
| 6,055,948 | A | 5/2000 | Shiraishi et al. | |
| 6,708,905 | B2 * | 3/2004 | Borissov et al. | 239/584 |

FOREIGN PATENT DOCUMENTS

| | | |
|---|---|---|
| WO | WO 91/11609 | 8/1991 |

* cited by examiner

*Primary Examiner*—Steven J. Ganey
(74) *Attorney, Agent, or Firm*—Rothwell, Figg, Ernst & Manbeck

(57) ABSTRACT

A system for assisting in the atomisation of liquid particles conveyed in a gas stream flowing along a flow path having a rigid boundary, said system involving the creation of one or more shock waves in the gas stream. In a preferred embodiment, the system comprises a fuel injection nozzle (10) comprising a fluid flow passage (43) terminating at a discharge orifice (15) and incorporating a delivery port (33) defined between a valve seat (31) and a valve member (23) movable with respect to the valve seat for opening and closing the delivery port. Fuel is delivered along the fluid flow passage (43) into a combustion chamber through the discharge orifice (15) upon opening of the delivery port (33). The valve member (23) devines an inner boundary surface (47) of the flow passage (43) and the valve seat (31) defines at least part of an outer boundary surface (45) of the flow passage (43). The inner and outer boundary surfaces (47, 45) are configured to generate one or more shock waves in an air-fuel mixture flowing at supersonic speed therebetween.

51 Claims, 6 Drawing Sheets

SHOCKWAVE INJECTOR NOZZLE

FIELD OF THE INVENTION

This invention relates to the atomisation of liquid particles entrained in a gas stream. More particularly, the invention is concerned with an apparatus for, and a method of, atomising liquid particles entrained in a gas stream such as air.

The invention has been devised particularly, although not solely, for the atomisation of liquid fuel for an internal combustion engine where the fuel is delivered to a combustion chamber of the engine using an air assist fuel injection system. The invention may, however, have application in various other fields, including in the field of gas turbines, as well as, for example, in atomisation systems for spray paint guns and aerosol spray nozzles.

BACKGROUND ART

In a direct in-cylinder fuel injection system, it is important to achieve and maintain acceptable atomisation of fuel delivered to an engine, as well as to inject the atomised fuel into a combustion chamber of the engine within a required time interval, in order to efficiently control fuelling to, and hence operation of, the engine.

Air assist fuel injection systems have been developed in an endeavour to accommodate such fuelling requirements. Examples of such air assist fuel injection systems are disclosed in U.S. Pat. No. 4,693,224 and RE 36768, both of which have been assigned to the Applicant and the contents of which are incorporated herein by way of reference.

It can, however, be difficult to achieve and maintain atomisation to an extent which provides optimal fuel droplet size, particularly at high fuelling rates. It is also important in direct in-cylinder fuel injection systems to prevent or at least minimise the formation of any carbon deposits on or adjacent the fuel delivery surfaces which may otherwise impede the shape and nature of the fuel spray delivered into the combustion chamber of the engine.

It is against this background, and the problems and difficulties associated therewith, that the present invention has been developed.

DISCLOSURE OF THE INVENTION

The present invention provides a system for assisting in the atomisation of liquid particles conveyed in a gas stream flowing along a flow path having a rigid boundary, said system involving the creation of one or more shock waves in the gas stream.

The shock waves subject the gas stream to a pressure disturbance which imparts a pressure gradient across the liquid particles thereby causing the particles to fragment.

The shock waves may be oblique shock waves, normal shock waves, or expansion shock waves, or any combination of oblique shock waves, normal shock waves, and expansion shock waves. Expansion shock waves may also be referred to as Prandtl-Meyer waves.

Optimal atomisation may be achieved by utilisation of both oblique shock waves and expansion shock waves.

The atomisation process is enhanced by reflection and intersection of the shock waves. Conveniently, the interaction of the shock waves artificially creates a low pressure region along the flow path through which the liquid particles must traverse.

The oblique shock waves essentially cause a differential relative air velocity across the liquid particles in the gas stream tending to decelerate the liquid particles, so assisting the atomisation process. The expansion shock waves cause an acceleration of the liquid particles in the gas stream, this also assisting the atomisation process. In each case, the presence or occurrence of these shock waves causes the liquid particles in the gas stream to experience an "apparent wind" which affects the speed of the liquid particles.

Oblique shock waves may be generated by passing the gas stream with the liquid particles entrained therein at a supersonic flow rate along the flow path and causing the supersonic flow to change direction by incorporating a directional change or obstruction in a boundary surface converging towards the flow. Conveniently, the directional change in the boundary surface is provided by a discontinuity in the boundary surface. The discontinuity may be of any suitable form such as an angular corner, a multitude of successive corners or a rounded corner (typically a concave curve).

Normal shock waves occur normal to the gas stream with the liquid particles entrained therein and since the shock wave is normal to the direction of the supersonic flow, the velocity of the gas stream after the normal shock is typically reduced.

An expansion shock wave may be generated by passing the gas stream with the liquid particles entrained therein at a supersonic flow rate along a flow path incorporating a directional change in the boundary surface involving a divergence from the flow. Conveniently, the directional change in the boundary surface is provided by a discontinuity such as a corner in the boundary surface. The corner may again be of any suitable form such as an angular corner, a multitude of successive corners or a rounded corner (typically a convex curve).

The flow path or at least a section thereof may be configured as a convergent-divergent nozzle.

Where the flow path or at least a section thereof is configured as a convergent-divergent nozzle, shock waves may be generated in the diverging section thereof. Since one or more shock waves produced in the diverging section of the nozzle is normal to the direction of the supersonic flow, the velocity of the gas stream after the normal shock is reduced.

The present invention also provides an apparatus for atomising liquid particles entrained in a gas flow, the apparatus comprising a fluid flow passage defined between first and second boundary surfaces configured to generate one or more shock waves in the gas flow when the gas flow is moving at supersonic speed therebetween.

Preferably, at least one of the first or secondary boundary surfaces is configured to provide one or more directional changes to produce one or more oblique shock waves or expansion shock waves within the fluid flow passage. Typically, the first and second boundary surfaces are each configured to provide a series of directional changes to produce a pattern of oblique shock waves in conjunction with expansion waves.

The flow passage may be defined by a nozzle having a discharge orifice, with the liquid particles being subjected to the shock waves in the nozzle prior to issuing from the nozzle through the discharge orifice. By using flow changing geometries such as ramped or angled nozzle faces and multi-faceted seat and poppet nozzle geometries, a combination of interacting shock waves is produced in the fluid flow passage. The specific shape or configuration of the ramped or angled nozzle faces and the angle of the resulting oblique shock wave is typically dependent on the local upstream Mach number. Accordingly, the location of a ramp or corner within the fluid flow passage is a function of the local Mach number which may be determined by the local ratio of cross-sectional areas in, for example, a divergent section of the fluid flow passage.

In an air assist fuel injection system for an internal combustion engine, the nozzle may comprise a fuel injection nozzle. The fuel injection nozzle may comprise the fluid flow passage terminating at the discharge orifice and incorporating a delivery port defined between a valve seat and a valve member movable with respect to the valve seat for opening and closing the delivery port, with fuel being delivered along the fluid flow passage into a combustion chamber of the engine through the discharge orifice upon opening of the delivery port.

Conveniently, the fuel injection nozzle may be arranged to deliver fuel directly into the combustion chambers of an engine.

More preferably, the fuel is delivered along the fluid flow passage and through the discharge orifice by a quantity of air which entrains the fuel and promotes the atomisation thereof.

The fluid flow passage may be defined between the valve member and a body which surrounds the valve member and which incorporates the valve seat. The valve member defines an inner boundary surface of the flow passage, and the body including the valve seat defines an outer boundary surface of the flow passage. The valve seat may be located at, or upstream of, the discharge orifice. Typically, the profile of the valve seat, and the corresponding section of the valve member adapted to sealingly engage the valve seat, form part of the configuration of the boundary surfaces.

In such an arrangement, shock waves reflect from the inner and outer boundary surfaces. For example, oblique shock waves reflect from an opposite boundary surface as oblique waves, and expansion shock waves reflect from an opposite boundary surface as expansion waves. Typically, the shock waves are provided in the fuel injection nozzle and hence promote sonic fuel spray formation.

Preferably, the nozzle is configured such that there is interaction between the shock waves, as well as their reflected waves. Conveniently, this interaction provides a crisscross array of shock waves through which the liquid particles must traverse. The liquid particles in the gas or air stream are therefore exposed to pressure gradients generated by the shock waves causing them to fragment. Additionally, the liquid particles are exposed to shear velocity conditions further assisting fragmentation. The shear velocity conditions arise because gas velocity changes in both direction and magnitude in a very small distance. The expansion waves further increase the pressure and velocity gradients.

Preferably, the inner and outer boundary surfaces are each configured to provide a series of directional changes to produce a pattern of oblique shock waves in conjunction with expansion waves. In a fuel injector nozzle utilising an outwardly opening poppet valve, oblique shock waves would be generated from the valve seat and expansion waves would propagate from the poppet valve. This is particularly applicable to injector nozzles which are arranged to produce an axial flow exit spray plume.

In certain fuel injector nozzle designs, it is usual for there to be relatively large liquid particles or a boundary layer liquid flow which attaches to the boundary surfaces. Conveniently, any liquid particles or boundary layer liquid flow attached to the boundary surfaces may be liberated at the discontinuities or corners by virtue of their momentum to thereby be exposed to the gas flow. That is, the direction changing profiles within the nozzle force the surface flowing particles and liquid to be liberated off the surface and into the gas flow. Upon being liberated, the liquid particles have a flight path different from the direction of gas flow. This exposes the liquid particles to an "apparent wind" which assists in the atomisation process of the liquid particles by increasing their Weber numbers. By way of explanation, the fragmentation regime of a droplet is determined by its characteristic Weber number. Fragments produced by a droplet with a higher Weber number are smaller than fragments produced by a droplet with a lower Weber number. The differential velocity and the "apparent wind" to which the liquid particles are exposed also enhances evaporation in the liquid particles.

The present invention also provides a fuel injection nozzle comprising a fluid flow passage terminating at a discharge orifice and incorporating a delivery port defined between a valve seat and a valve member movable with respect to the valve seat for opening and closing the delivery port, with fuel being delivered along the fluid flow passage into a combustion chamber through the discharge orifice upon opening of the delivery port, wherein the valve member defines an inner boundary surface of the flow passage and the valve seat defines at least part of an outer boundary surface of the flow passage, the inner and outer boundary surfaces being configured to generate one or more shock waves in an air-fuel mixture flowing at supersonic speed therebetween.

Typically, the inner and outer boundary surfaces are each configured to provide a series of directional changes to produce a pattern of oblique shock waves in conjunction with expansion waves. Conveniently, the inner and outer boundary surfaces at the delivery port are configured such that the expansion shock waves occur internally to the delivery port.

Conveniently, the outermost extremities of the inner and outer boundary surfaces may be configured to correspond at the exit point of the delivery port. That is, the outermost extremities of the inner and outer boundary surfaces may be arranged to be immediately adjacent one another at the exit of the delivery port. Preferably, no surfaces extend downstream beyond the discharge orifice of the fuel injection nozzle. In certain engine applications, such an arrangement where no nozzle surface exists beyond the delivery port may be preferable and avoid the build-up of carbon deposits at or adjacent the discharge orifice.

Alternatively, the valve member may be provided with an extension portion which extends beyond the discharge orifice of the fuel injection nozzle and which presents a flow directing surface to which the air-fuel mixture issuing through the orifice is exposed.

Preferably, the flow directing surface is a curved surface (which is convex relative to the air-fuel flow) and is positioned so as to be in the flight path of any fuel droplets or liquid particles issuing through the discharge orifice.

The flow directing surface provides a solid boundary on the inner side of the air-fuel mixture issuing from the discharge orifice as a spray plume. The curved nature of the surface influences the flow direction of the plume involving a change of direction to consequently generate expansion waves which propagate outwardly as a Prandtl Meyer expansion fan from the curved surface to traverse the flow path of the plume. These expansion waves have been found to generate a low pressure, high velocity zone in the plume which further increases the air velocities and hence further assists in atomisation of the fuel.

Conveniently, the inner and outer boundary surfaces of the fuel injection nozzle, and/or the extension portion, are configured so as to reduce the formation of any carbon deposits at or adjacent the delivery port. Such deposits and other related particles may be produced by the combination of fuel within the combustion chamber of an engine, including incomplete combustion of residual fuel which may remain on the fuel delivery surfaces between injection or combustion cycles.

As well as improved atomisation of the fuel by way of the array of shock waves in the fuel injection nozzle which itself reduces the formation of such carbonaceous deposits, the sonic fuel spray formation promoted by the fuel injection nozzle and hence the high fluid velocities provides for a certain degree of deposit cleaning at the delivery end of the nozzle. In particular, the high surface velocities in the nozzle and the droplet bombardment induced thereby aid in the elimination and/or reduction of such carbon deposits.

Conveniently, the extension portion is in the form of a projection which depends downwardly from the valve member and is configured to provide a guidance surface to promote a desired shaping of the fuel spray which issues from the fuel injection nozzle.

The invention further provides a fuel injection nozzle comprising a discharge orifice through which an air-fuel charge can issue, and a surface disposed outwardly of the discharge orifice in the direction of fuel-air flow, the surface being configured to generate expansion waves in the fuel-air charge issuing from the discharge orifice, the expansion waves propagating in a direction which traverses the fuel-air charge.

Conveniently, the fuel injection nozzle may be arranged to deliver fuel directly into the combustion chambers of an engine.

The present invention also provides a method of atomising liquid particles entrained in a gas flow, characterised by the creation of one or more shock waves in the gas flow.

The shock waves subject the gas flow to a pressure disturbance which imparts a pressure gradient across the liquid particles thereby causing the particles to fragment. The shock waves may be generated by passing the gas flow with the liquid particles entrained therein along a flow path at a supersonic flow rate and causing the supersonic flow to change direction.

Oblique shock waves are generated where the supersonic flow is caused to change direction by incorporating a directional change or obstruction in a boundary surface converging towards the flow. Expansion shock waves are generated by causing a directional change in the supersonic flow involving a divergence from the flow.

Preferably, the shock waves generated comprise oblique shock waves and expansion shock waves providing a combination of interacting shock waves.

The invention also provides a method of injecting fuel into an internal combustion engine having a combustion chamber, comprising the steps of delivering a flow comprising a metered quantity of fuel entrained in a gas to the combustion chamber through a selectively openable delivery port to provide a fuel spray issuing from the port when opened, and subjecting the flow to one or more shock waves to assist atomisation of liquid fuel droplets in the flow.

The liquid fuel droplets may be subjected to the shock waves prior to, during and/or after passing through the delivery port.

Preferably, the delivery port when opened defines a flow passage having a boundary surface with a series of directional changes therein.

Preferably the delivery port when opened defines a convergent-divergent nozzle.

BRIEF DESCRIPTION OF THE DRAWINGS

The invention will be better understood by reference to the following description of several specific embodiments thereof as shown in the accompanying drawings in which.

BEST MODE(S) FOR CARRYING OUT THE INVENTION

Figure 1:
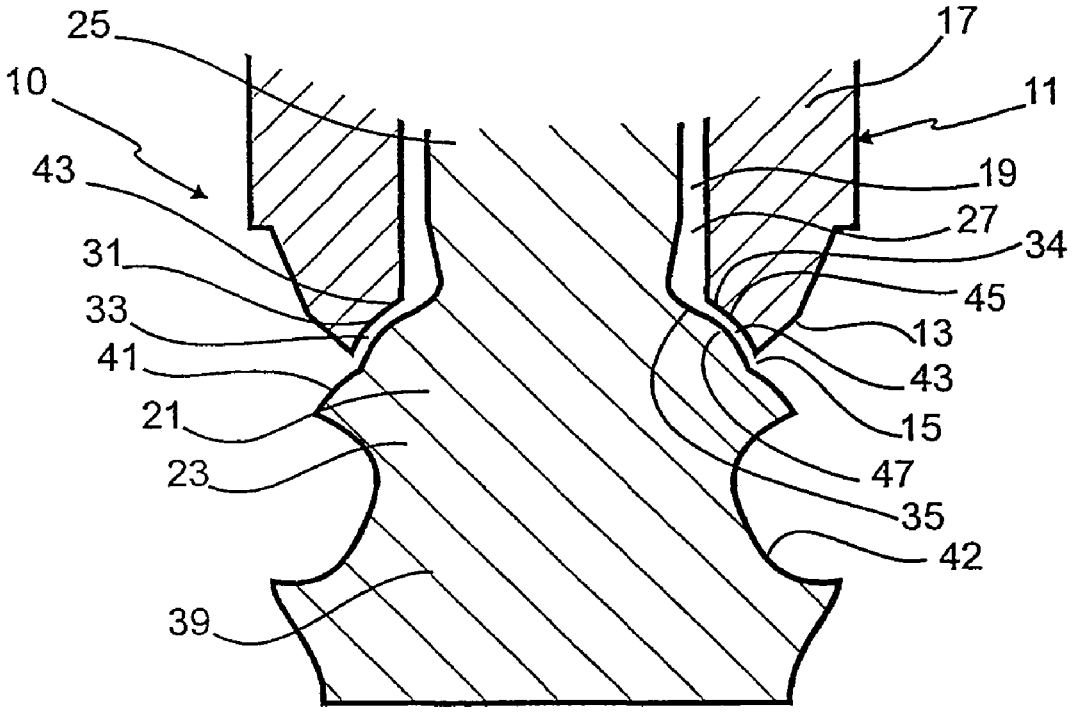
FIG. 1 is a fragmentary view of the delivery end of a fuel injection nozzle according to a first embodiment.
Figure 2:
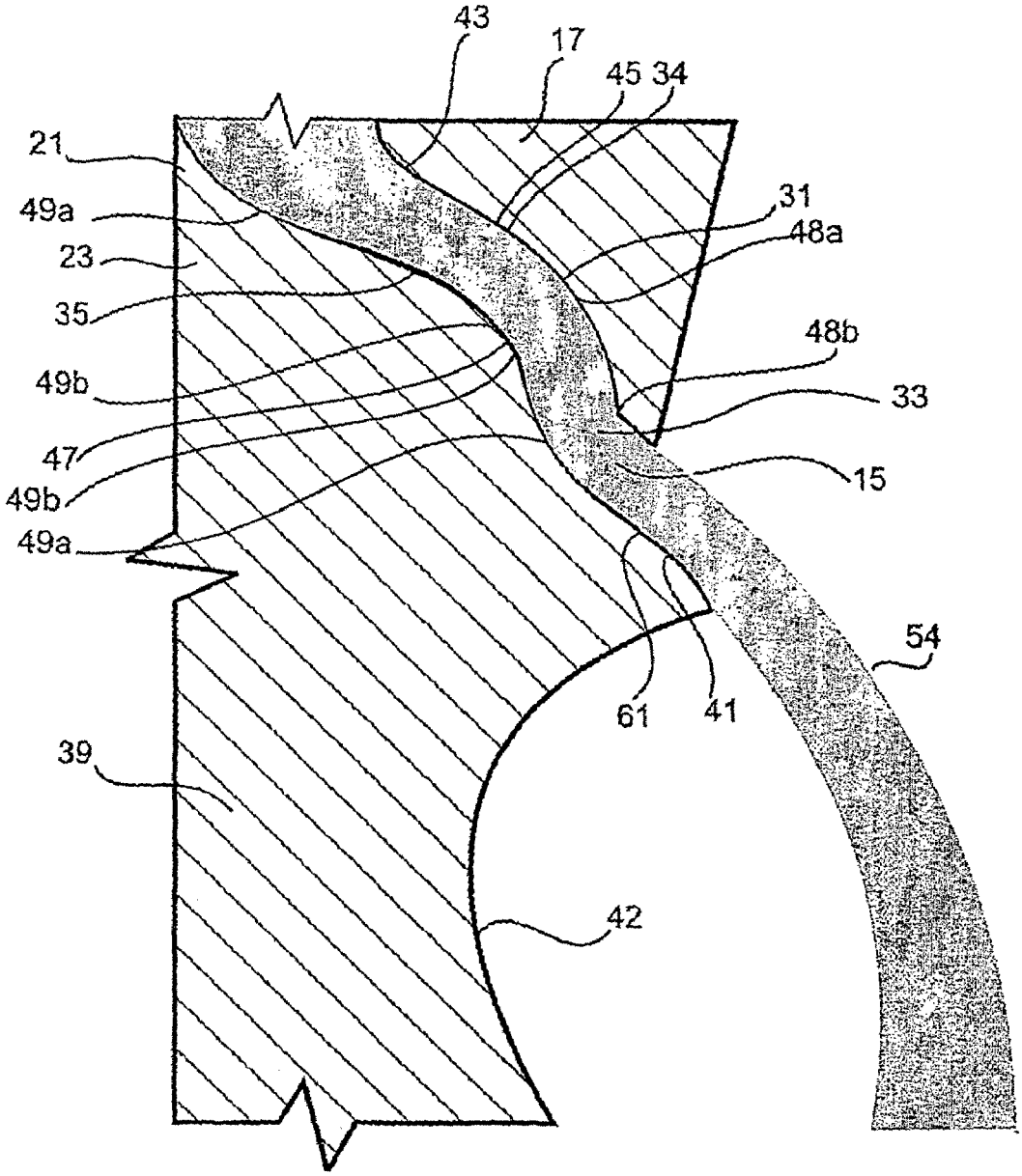
FIG. 2 is a schematic view, on an enlarged scale, showing the configuration of a valve seat and corresponding valve sealing face incorporated in the fuel injection nozzle of FIG. 1.

Referring to FIGS. 1 to 5 of the drawings, there is shown a fuel injection nozzle 10 for an internal combustion engine having a combustion chamber into which fuel is delivered by the nozzle 10 by way of a dual fluid direct injection process. Dual fluid fuel injection systems in which fuel is delivered entrained in air are known, examples of such being disclosed in the Applicant's U.S. Pat. No. 4,693,224 and RE 36768, the contents of which are incorporated herein by way of reference.

The fuel injection nozzle 10 comprises a valve body 11 having a delivery end 13 incorporating a discharge orifice 15. The valve body 11 comprises a valve housing 17 having a central bore 19 and a valve 21 associated with the valve housing 17. The valve 21 has a valve member 23 at one end of a valve stem 25 which is guided for reciprocate movement within the bore 19 by any suitable means (not shown). The valve stem 25 is smaller in size that the bore 19 such that an annular passage 27 is defined between the valve stem 25 and the side of the bore 19. The annular passage 27 carries a fuel entrained in a gas to the combustion chamber of the engine. The gas in which the fuel is entrained is preferably an oxidant such as air.

It is to be noted that alternative configurations for conveying the fuel and/or air to the discharge orifice may also be implemented with the nozzle 10 still incorporating the necessary elements of the present invention. For example, the valve stem 25 may be hollow as is shown in the applicant's US patent RE 36768, with one or more orifices being provided upstream of the valve member 23 so as to enable the transfer of fuel and/or air from within the valve stem 25 to the annular passage 27.

The valve member 23 co-operates with a valve seat 31 provided in the valve housing 17 at the delivery end 13 of the valve body 11. The valve member 23 and valve seat 31 co-operate to define a delivery port 33. The valve seat 31 has a seat face 34. The valve member 23 is of the outwardly opening or poppet-type. The valve member 23 has a sealing face 35 moveable into and out of sealing engagement with the seat face 34 for opening and closing the delivery port 33. With this arrangement, a metered quantity of fuel entrained in gas is delivered directly into the combustion chamber through the selectively openable delivery port 33 to provide a fuel spray, issuing from the discharge orifice 15 when the delivery port 33 is opened.

The valve member 23 incorporates an extension portion 39 which presents a curved surface 41 adjacent the discharge orifice 15, the purpose of which will be explained later. The extension or projection portion 39 may be of any suitable configuration and include certain desirable features to provide for a certain degree of guidance of the fuel spray issuing from the nozzle 10. Such projections are discussed in the applicant's U.S. Pat. Nos. 5,551,638 and 5,833,142 and co-pending PCT patent application PCT/AU01/00382, the contents of which are included herein by way of reference.

The valve seat 31 and the valve member 23 co-operate to define a flow passage 43 therebetween when the valve member 23 is out of engagement with the valve seat 31. The flow passage 43 has an outer boundary 45 defined by the seat face 34 of the valve seat 31 and an inner boundary 47 defined by the sealing face 35 of the valve member 23.

The outer and inner boundary surfaces 45, 47 are configured such that the flow passage 43 functions as a convergent-divergent nozzle. The air-fuel mixture is delivered to the entry section of the flow passage 43 so that there is choked flow at the entry section of the flow passage 43 followed by supersonic flow. More particularly, the outer and inner boundary surfaces 45, 47 are each configured to provide a series of directional changes to produce a pattern of oblique shock waves in conjunction with expansion waves in the supersonic flow. Specifically, the outer boundary surface 45 has several successive corners 48 formed therein involving a change of direction of the boundary surface with respect to the supersonic flow. Where the change of direction of the boundary surface 45 is towards the supersonic flow, such as at corner 48*a*, oblique shock waves are generated in the supersonic flow. Where the change in direction of the boundary surface 45 diverges from the supersonic flow, such as at corner 48*b*, expansion waves are generated in the supersonic flow.

Similarly, the inner boundary surface 47 has several successive corners 49 involving a change of direction with respect to the flow. Where the change in direction of the boundary surface 47 is towards the supersonic flow, such as at corner 49*a*, oblique shock waves are generated in the supersonic flow. Where the change in direction of the boundary surface 47 diverges from the supersonic flow, such as at corner 49*b*, expansion waves are generated in the supersonic flow. Hence, these corners 48, 49, which are essentially obstructions or surface discontinuities within the flow passage 43, promote the formation and reflection of oblique, normal and supersonic shock waves within the nozzle 10.

Figure 3:
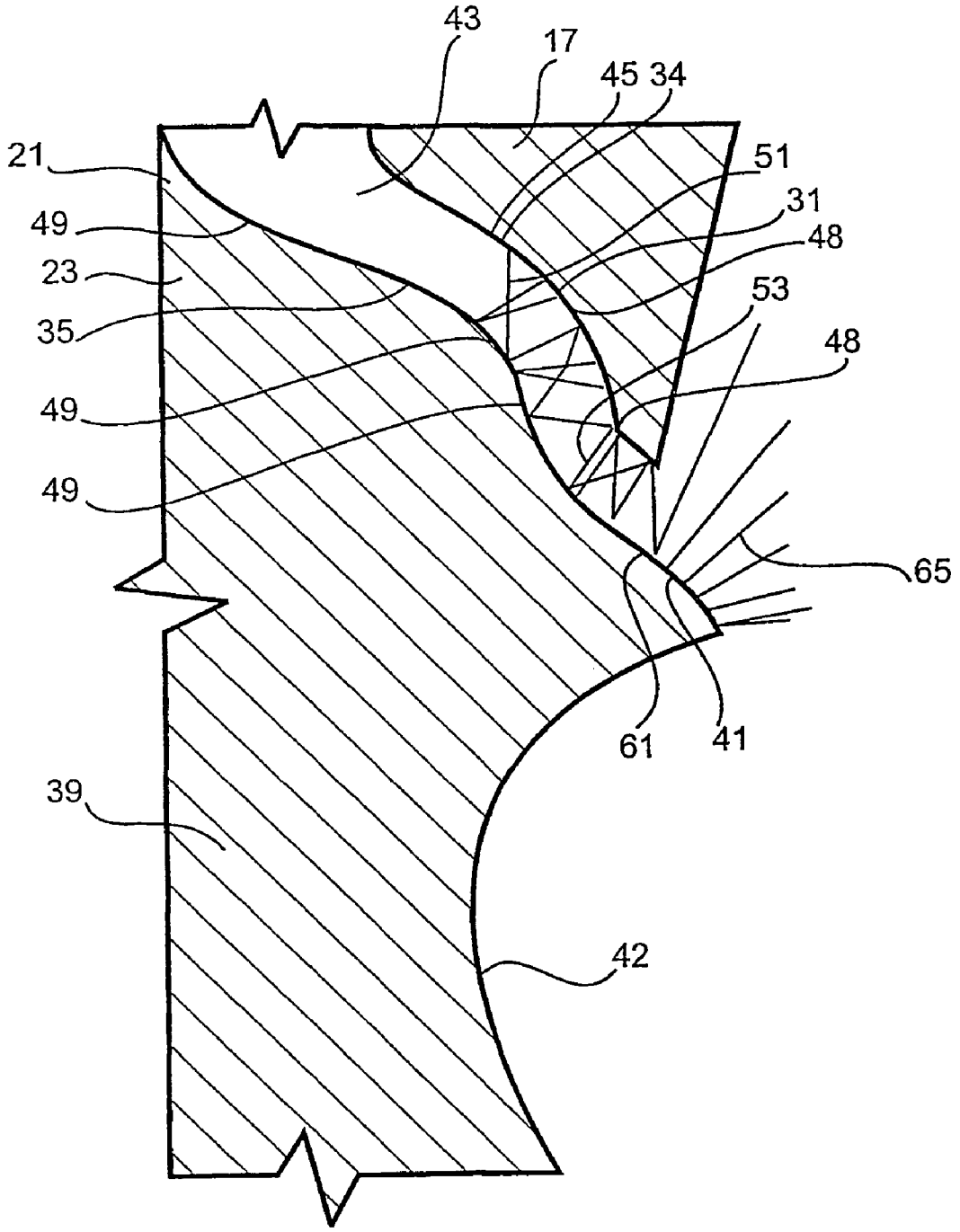
FIG. 3 is a schematic view illustrating shock waves generated during an injection event performed by the nozzle of FIG. 1.

The shock waves generated in the supersonic flow are illustrated schematically in FIG. 3 of the drawings, where reference numeral 51 indicates an oblique shock wave and reference numeral 53 indicates an expansion shock wave.

The shock waves generate pressure disturbances which impart a pressure gradient across fuel droplets in the gaseous flow within the flow passage 43, thereby causing the droplets to fragment. Furthermore, there is interaction between the generated shock waves producing further disturbances which assist the fragmentation process. Still further, shock waves reflect from the outer and inner boundary surfaces 45, 47 with further interaction between the shock waves and their reflected waves assisting the fragmentation process. The pressure disturbances within the flow passage 43 further serves to enhance the delivery speed of the fluid traversing through the passage 43 which also contributes to better atomisation of the fuel.

As can be seen from FIG. 3, the interaction between the various shock waves and reflected waves provides a criss-cross array of shock waves through which the fuel droplets must traverse. The fuel droplets are therefore exposed to pressure gradients causing the droplets to fragment. Because of the shock waves, the velocity conditions change in both direction and magnitude in very small distances along the flow path. This provides shear velocity conditions to which the fuel droplets are exposed to further assist the fragmentation process.

It is usual for relatively large fuel droplets or a boundary layer liquid flow to attach to the boundary surfaces 45, 47 while being conveyed along the flow passage 43. Fuel droplets attached to the boundary surfaces 45, 47 are liberated at the corners 48, 49 by virtue of their momentum and so are caused to fully enter the gas stream. That is, the direction changing profiles on the seat face 34 and sealing face 35 force the surface flowing liquids or particles to be liberated from the surfaces 45, 47. Upon being liberated at the corners 48, 49, the fuel droplets have a different flight path from the direction of the gas flow and so are exposed to an "apparent wind" which assists the atomisation process of the fuel droplets by increasing their Weber numbers. The fuel droplets are also exposed to enhanced evaporation which further assists atomisation.

Figure 4:
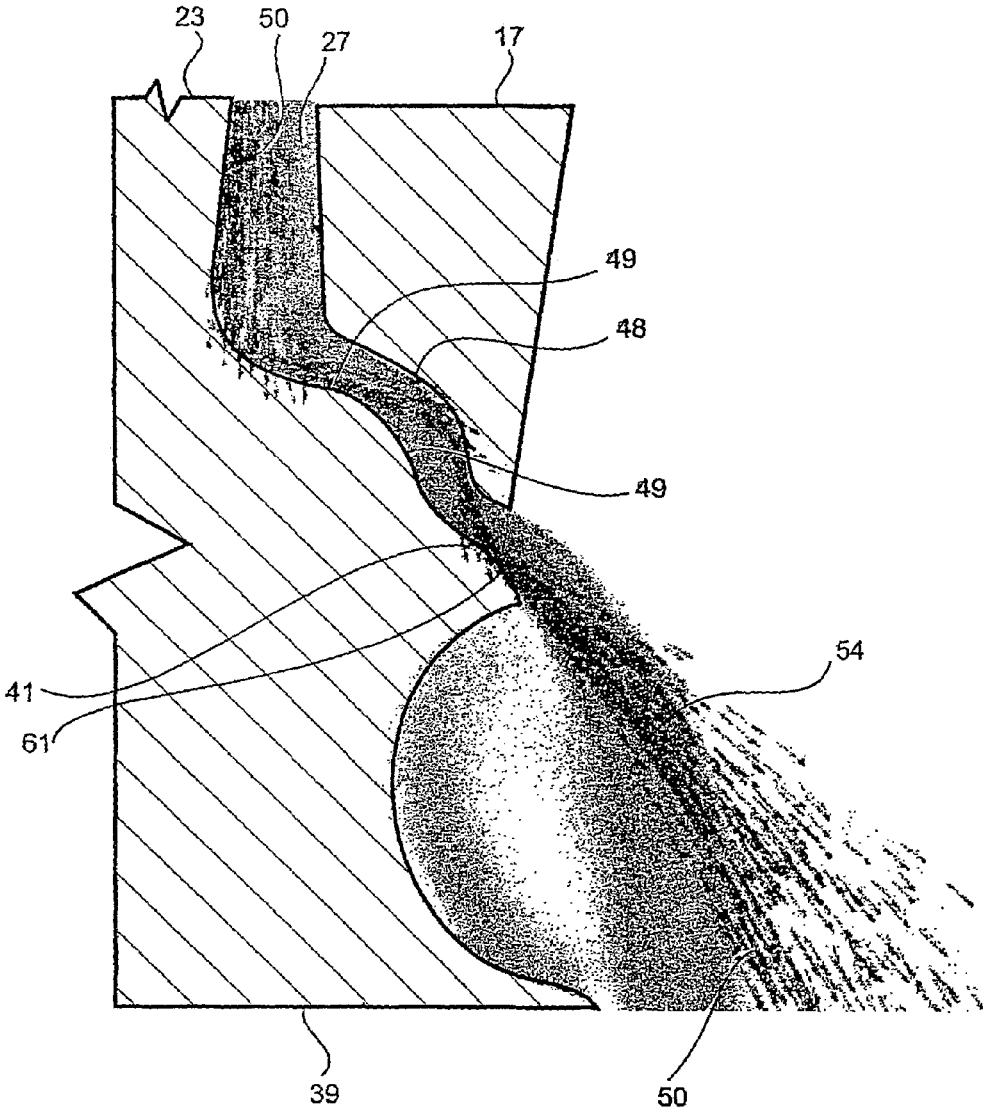
FIG. 4 is a schematic view illustrating the flight paths of fuel droplets in an air fuel mixture during delivery thereof by the nozzle of FIG. 1.

The flight paths of fuel droplets moving along the flow passage 43 is illustrated schematically in FIG. 4 of the drawings. The fuel droplets are identified by reference numeral 50.

As previously mentioned, the extension portion 39 of the valve member 23 presents a curved surface 41 which is so positioned in relation to the discharge orifice 15 that it is in the flight path of any fuel droplets 50 issuing from the discharge orifice 15, as illustrated in FIG. 4 of the drawings. The curved surface 41 is in the form of a convex curve and provides an inner boundary surface 61 for the plume 54 of the air-fuel mixture delivered by the nozzle 10.

It has been found that the curved surface 41 interacts with the air-fuel mixture plume 54 to propagate expansion waves across the path traversed by the air-fuel mixture. The expansion waves (typically in the form of an expansion fan) are illustrated schematically in FIG. 3 of the drawings and are depicted by reference numeral 65.

The curved surface 41 may be of any desirable length and may in fact be relatively short such that the outermost extremities of the inner and outer boundary surfaces 45,47 are substantially adjacent one another at the exit of the discharge orifice 15.

Figure 5:
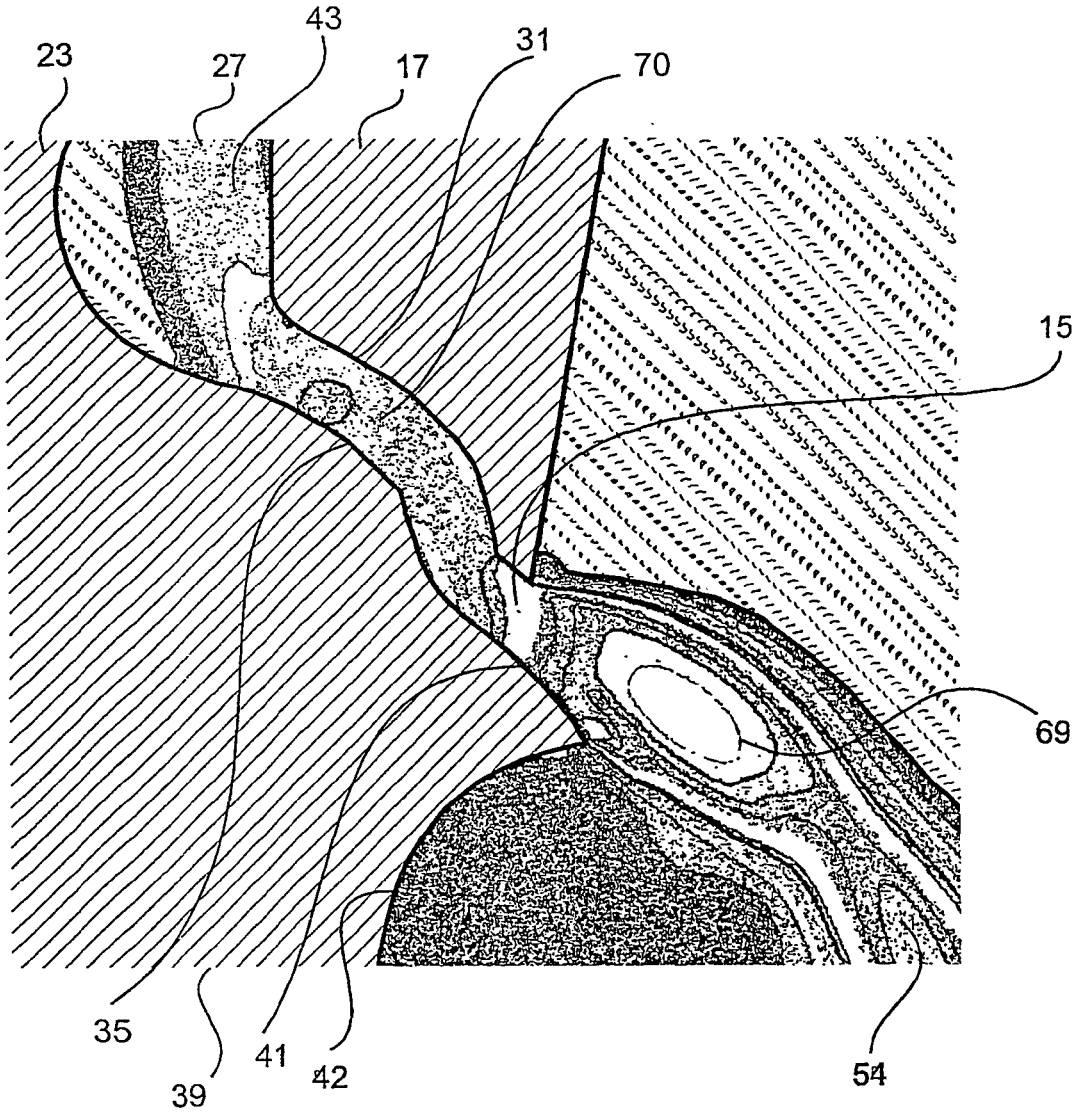
FIG. 5 is a fragmentary schematic view incorporating a velocity profile of the air-fuel mixture at a specific point during an injection event.

The expansion waves 65 have the effect of generating velocity gradients within the plume 54, with the result being that a high velocity zone 69 of low pressure develops in the plume 54 as can be seen from FIG. 5. The velocity of the fuel spray upstream of the discharge orifice 15 within the nozzle 10 as indicated by zone 70 is typically less than half of that at zone 69. The presence of the zone 69 further assists the atomisation of fuel droplets in the spray plume 54.

As alluded to hereinbefore, the extension portion 39 may include other desirable features such as a cut-out region 42 for further controlling the plume 54 if desired.

Figure 6:
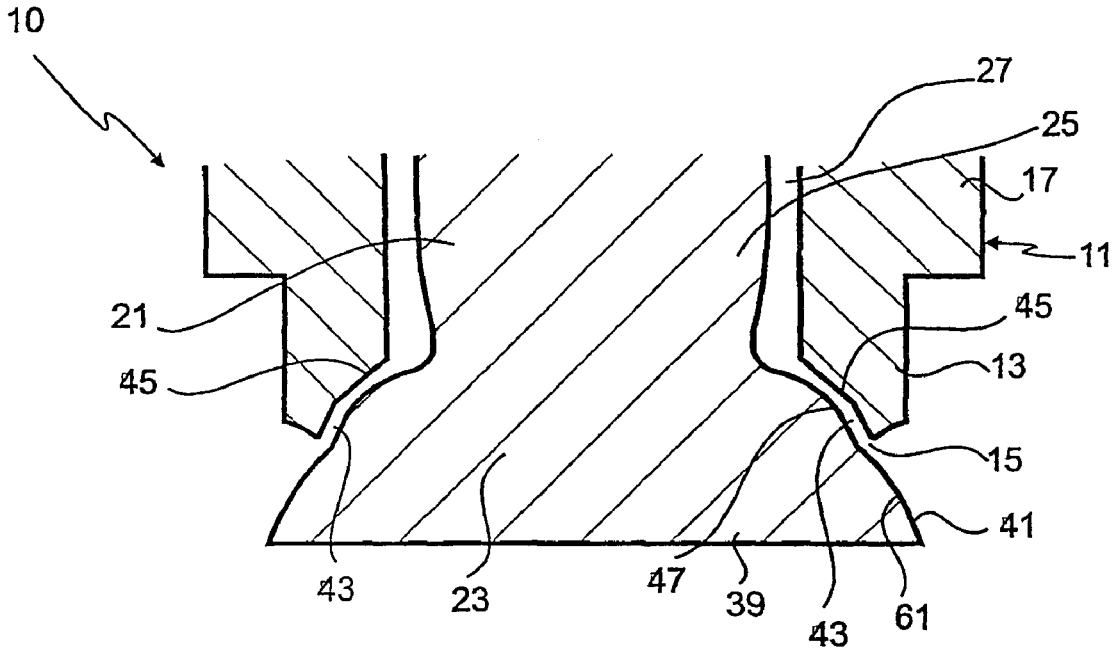
FIG. 6 is a fragmentary view of the delivery end of a fuel injection nozzle according to a second embodiment.

Referring now to FIG. 6 of the drawings, there is shown the delivery end of a fuel injection nozzle 10 according to a second embodiment. The fuel injection nozzle 10 according to the second embodiment is somewhat similar to that of the first embodiment with the exception that the projection 39 is of minimal form so as to only provide the feature of the curved surface 41. Accordingly, the reference numbering for the individual features of the nozzle 10 is repeated in FIG. 2. In this embodiment, the projection 39 is not a downstream projection for providing guidance of the fuel flow as is discussed in the applicant's U.S. Pat. Nos. 5,551,638 or 5,833,142, but rather is simply an extension to the valve member 23 to enable the provision of the curved surface 41.

Still further and as mentioned hereinbefore, the provision of the curved surface 41 may not be desirable in certain engine applications in which case the outermost extremities of the boundary surfaces 45,47 may be arranged to coincide at the discharge orifice 15. This arrangement may of course also be applicable for use with a downstream projection such as that described in any of the applicant's aforementioned US patents.

From the foregoing, it is evident that the present invention provides a simple yet highly effective way of enhancing the atomisation process of fuel droplets in an air-fuel mixture delivered by a fuel injection nozzle. A particular advantage is that the invention can be implemented without great difficulty, as all that is required is to machine the valve seat and valve member to the required profile configurations. Accordingly, this potentially enables the provision of the present invention at little to no extra cost.

As alluded to hereinbefore, due to the promotion of sonic fuel spray formation and the associated high surface velocities which can be achieved at and adjacent the discharge orifice 15, the present invention offers certain advantages in respect of the reduction of undesirable carbon deposit formation. This is primarily due to the improved level of atomisation that is achieved together with the deposit cleaning or removal effect provided by the sonic fuel flow.

While the invention has been described with respect to fuel injection nozzles incorporating outwardly-opening poppet valves, it should be appreciated that it can equally be applied to other types of fuel injection nozzles. Furthermore, the invention is equally applicable for use in direct injection or non direct injection applications.

Additionally, it should be appreciated that there may be instances where generation of expansion waves outwardly of the injection nozzle are not required, in which case the valve member 23 need not include the extension portion 39 and/or curved surface 41. Similarly, it should be appreciated that there may be other instances where it is not required to generate shock waves within the nozzle 10 and shock waves only outwardly of the delivery orifice 15 are needed. In such a case the extension portion 39 presenting curved surface 41 may be utilised without the need for the specified configurations of the valve member 23 and valve seat 31 within the flow passage 43.

Still further, it should be understood that the invention is not limited to atomisation of liquid fuel for an internal combustion engine. As previously mentioned, the invention may have application in various other fields, including an air assist fuel injection system for a gas turbine, as well as in atomisation systems for paint sprays, metal sprays and other aerosol boxed sprays.

Modifications and variations as would be deemed obvious to the person skilled in the art are included within the ambit of the present invention.

Throughout the specification, unless the context requires otherwise, the word "comprise" or variations such as "comprises" or "comprising", will be understood to imply the inclusion of a stated integer or group of integers but not the exclusion of any other integer or group of integers.

What is claimed is:

1. An apparatus for atomising liquid particles conveyed in a gas flow, the apparatus comprising a fluid flow passage defined between first and second boundary surfaces and a movable element for controlling the flow of liquid through the passage, at least one of the first and second boundary surfaces being configured to generate one or more oblique shockwaves and/or expansion shockwaves in the gas flow and within the fluid flow passage when the gas flow is moving at supersonic speed therethrough.

2. Apparatus according to claim 1 wherein said at least one boundary surface is so configured to generate oblique shock waves by incorporation of a directional change or obstruction in a boundary surface converging towards the flow.

3. Apparatus according to claim 2 wherein the or each directional change in the respective boundary surface is provided by a discontinuity in the boundary surface.

4. Apparatus according to claim 2 wherein the or each directional change in the respective boundary surface is provided by a discontinuity in the boundary surface the discontinuity is selected from a group comprising an angular corner, a multitude of successive corners or a rounded corner.

5. Apparatus according to claim 1 wherein said at least one boundary surface is so configured to generate expansion shock waves by incorporation of a directional change in the boundary surface involving a divergence from the flow.

6. Apparatus according to claim 1 wherein the first and second boundary surfaces are each configured to provide a series of directional changes to produce a pattern of oblique shock waves in conjunction with expansion waves.

7. Apparatus according to claim 1 wherein the fluid flow passage or at least a section thereof is configured as a convergent-divergent nozzle.

8. Apparatus according to claim 7 wherein the shock waves are generated in the diverging section of the nozzle.

9. Apparatus according to claim 1 wherein the flow passage is defined by a nozzle having a discharge orifice, with the liquid particles being subjected to the shock waves in the nozzle prior to issuing from the nozzle through the discharge orifice.

10. Apparatus according to claim 9 wherein the nozzle comprises a first element defining the first boundary surface and a second element defining the second boundary surface.

11. Apparatus according to claim 9 wherein the nozzle comprises a fuel injection nozzle in an air assist fuel injection system for an internal combustion engine.

12. Apparatus according to claim 9 wherein the nozzle comprises a fuel injection nozzle in an air assist fuel injection system for an internal combustion engine the fuel injection nozzle comprises a fluid flow passage terminating at the discharge orifice and incorporating a delivery port, the movable element providing a valve member co-operating with a valve seat to define the delivery port therebetween, the valve member being movable with respect to the valve seat for opening and closing the delivery port, with fuel being delivered along the fluid flow passage into a combustion chamber of the engine through the discharge orifice upon opening of the delivery port.

13. Apparatus according to claim 12 wherein the fuel is delivered directly into the combustion chamber of the engine by the fuel injection nozzle.

14. Apparatus according to claim 12 wherein the fuel is delivered along the fluid flow passage and through the discharge orifice by a quantity of air which entrains the fuel and promotes the atomisation thereof.

15. Apparatus according to claim 14 wherein the fluid flow passage is defined between the valve member and a body which surrounds the valve member and which incorporates the valve seat, the valve member defining an inner boundary surface of the flow passage and the body including the valve seat defining an outer boundary surface of the flow passage.

16. Apparatus according to claim 15 wherein the inner and outer boundary surfaces are each configured to provide a series of directional changes to produce a pattern of oblique shock waves in conjunction with expansion waves.

17. Apparatus according to claim 15 wherein shock waves reflect from the inner and outer boundary surfaces.

18. Apparatus according to claim 17 wherein the nozzle is configured such that there is interaction between the shock waves, as well as their reflected waves, to provide a criss-cross array of shock waves through which the liquid fuel particles must traverse.

19. Apparatus according to claim 12 wherein the valve seat is located at or upstream of the discharge orifice.

20. Apparatus according to claim 12 wherein the profile of the valve seat, and the corresponding section of the valve member adapted to sealingly engage the valve seat, form part of the configuration of the boundary surfaces.

21. Apparatus according to claim 12 wherein the fuel injection nozzle comprises an outwardly opening poppet valve, and wherein oblique shock waves generate from the valve seat and expansion waves propagate from the poppet valve.

22. Apparatus according to claim 12 wherein the fuel injection nozzle comprises a projection extending downwardly from the valve member which is configured to promote a desired shaping of a fluid spray issuing from the discharge orifice.

23. Apparatus according to claim 9 further comprising a surface disposed outwardly of the discharge orifice in the direction of liquid-gas flow, the surface being configured to generate expansion waves in the liquid-gas flow issuing from the discharge orifice, the expansion waves propagating in a direction which traverses the liquid-gas flow.

24. Apparatus according to claim 1 wherein the boundary surfaces are configured to promote reflection of shockwaves generated in the fluid flow passage.

25. Apparatus according to claim 1 wherein the boundary surfaces are configured to promote the reflection and/or interference of shockwaves generated in the flow passage to promote pressure disturbances therein for assisting the atomisation of the liquid particles.

26. Apparatus according to claim 1 wherein the boundary surfaces are configured in the direction of fluid flow to promote exposure of the liquid particles to shockwaves within the flow passage.

27. Apparatus according to claim 26 wherein the boundary surfaces are configured to promote separation of the liquid particles therefrom thereby to promote exposure of the liquid particles to the shockwaves.

28. An apparatus for atomising liquid particles conveyed in a gas flow, the apparatus comprising a fluid flow passage defined between first and second boundary surfaces and a movable element for controlling the flow of liquid through the passage, at least one of the first or second boundary surfaces being configured to provide one or more directional changes to produce one or more shockwaves in the gas flow and within the fluid flow passage when the gas flow is moving at supersonic speed therethrough.

29. Apparatus according to claim 28 wherein the shock waves comprise oblique shock waves, normal shock waves, or expansion shock waves, or any combination thereof.

30. Apparatus according to claim 29 wherein the shock waves comprise oblique shock waves and expansion shock waves.

31. Apparatus according to claim 28 wherein the shock waves interact to create a low pressure region along the fluid flow passage through which the liquid particles must traverse.

32. Apparatus according to claim 28 wherein the first and second boundary surfaces are each configured to provide a series of directional changes to produce a pattern of oblique shock waves in conjunction with expansion waves.

33. A fuel injection nozzle comprising a fluid flow passage terminating at a discharge orifice and incorporating a delivery port defined between a valve seat and a valve member movable with respect to the valve seat for opening and closing the delivery port, with fuel being delivered along the fluid flow passage into a combustion chamber through the discharge orifice upon opening of the delivery port, wherein the valve member defines an inner boundary surface of the flow passage and the valve seat defines at least part of an outer boundary surface of the flow passage, the inner and outer boundary surfaces being configured to generate one or more shock waves in an air-fuel mixture flowing at supersonic speed therebetween.

34. A fuel injection nozzle according to claim 33 wherein the inner and outer boundary surfaces are each configured to provide a series of directional changes to produce a pattern of oblique shock waves in conjunction with expansion waves.

35. A fuel injection nozzle according to claim 34 wherein the surfaces at the delivery port are configured such that the expansion shock waves occur internally to the delivery port.

36. A fuel injection nozzle according to claim 33 wherein the valve member is provided with an extension portion extending beyond the discharge orifice of the fuel injection nozzle and presenting a flow directing surface to which the air-fuel mixture issuing through the orifice is exposed.

37. A fuel injection nozzle according to claim 36 wherein the flow directing surface comprises a curved surface and is positioned so as to be in the flight path of any fuel droplets or liquid particles issuing through the discharge orifice.

38. A fuel injection nozzle according to claim 37 wherein the curved surface is convex.

39. A fuel injection nozzle according to claim 36 wherein the flow directing surface provides a solid boundary on the inner side of the air-fuel mixture issuing from the discharge orifice as a spray plume, and wherein the curved surface is adapted to influence the flow direction of the plume involving a change of direction to consequently generate expansion waves which propagate outwardly as a Prandtl Meyer expansion fan from the curved surface to traverse the flow path of the plume.

40. A fuel injection nozzle according to claim 33 wherein the inner and outer boundary surfaces of the fuel injection nozzle, and/or the extension portion, are configured so as to reduce the formation of any carbon deposits at or adjacent the delivery port.

41. A fuel injection nozzle according to claim 33 wherein the outermost extremities of the inner and outer boundary surfaces are configured to correspond at an exit point of the delivery port.

42. A fuel injection nozzle according to claim 33 wherein no surfaces extend downstream of the discharge orifice.

43. A fuel injection nozzle according to claim 33 further comprising a surface disposed outwardly of the discharge orifice in the direction of air-fuel flow, the surface being configured to generate expansion waves in the air-fuel charge issuing from the discharge orifice, the expansion waves propagating in a direction which traverses the air-fuel charge.

44. A method of atomising liquid particles entrained in a gas flow comprising the steps of passing the gas flow at a supersonic flow rate along a flow passage defined between first and second boundary surfaces one of which is movable for controlling the flow of liquid through the flow passage, and causing the supersonic gas flow to change direction within the flow passage and generate one or more shock-waves in the gas as it passes along the flow passage.

45. A method according to claim 44 wherein oblique shock waves are generated where the supersonic flow is caused to change direction by incorporating a directional change or obstruction in a boundary surface converging towards the flow.

46. A method according to claim 44 wherein expansion shock waves are generated by causing a directional change in the supersonic flow involving a divergence from the flow.

47. A method according to claim 44 wherein the shock waves generated comprise oblique shock waves and expansion shock waves providing a combination of interacting shock waves.

48. A method of injecting fuel into an internal combustion engine having a combustion chamber, comprising the steps of delivering a flow comprising a metered quantity of fuel entrained in a gas to the combustion chamber through a selectively openable delivery port to provide a fuel spray issuing from the port when opened, and subjecting the flow to one or more directional changes in the delivery port to generate one or more shock waves in the gas flow when the gas flow is moving at a supersonic flow rate through the delivery port to assist atomisation of liquid fuel droplets in the flow.

49. A method according to claim 48 wherein the liquid fuel droplets are subjected to the shock waves prior to, during and/or after passing through the delivery port.

50. A method according to claim 48 wherein the delivery port when opened defines a flow passage configured to generate one or more shockwaves in the gas flow.

51. A method according to claim 50 wherein the delivery port when opened defines a convergent-divergent nozzle.

* * * * *